US005868492A

United States Patent [19]

Strickland

[11] Patent Number: 5,868,492

[45] Date of Patent: Feb. 9, 1999

[54] LAMP SHADE ASSEMBLY AND THE METHOD OF FORMING SAME

[75] Inventor: Jerry D. Strickland, Jonesboro, Ark.

[73] Assignee: Partner Investments, Inc., West Memphis, Ark.

[21] Appl. No.: 724,552

[22] Filed: Sep. 30, 1996

[51] Int. Cl.[6] ..... F21V 1/06

[52] U.S. Cl. ..... 362/352; 362/357; 362/358

[58] Field of Search ..... 362/352, 357, 362/358

[56] References Cited

U.S. PATENT DOCUMENTS

| | | | |
|---|---|---|---|
| 2,122,971 | 7/1938 | Angeletti | 362/358 |
| 4,605,996 | 8/1986 | Payne | 1/6 |
| 4,625,268 | 11/1986 | Payne | 1/6 |
| 4,758,936 | 7/1988 | Maxwell | 362/352 |
| 4,994,949 | 2/1991 | Yeh et al. | 1/6 |
| 5,121,312 | 6/1992 | Hyland et al. | 1/6 |
| 5,193,902 | 3/1993 | Hyland et al. | 1/6 |
| 5,311,415 | 5/1994 | Hyland | 1/6 |

FOREIGN PATENT DOCUMENTS

| | | | |
|---|---|---|---|
| 82215298 | 5/1994 | Taiwan . | |
| 7682 of 1838 | | United Kingdom | 362/352 |
| 936272 | 9/1963 | United Kingdom | 362/352 |

*Primary Examiner*—Ira S. Lazarus
*Assistant Examiner*—David Lee
*Attorney, Agent, or Firm*—Walker, McKenzie & Walker, P.C.

[57] ABSTRACT

A lampshade assembly that includes only three parts, namely, a pleated lamp shade formed as a continuous resilient band having a plurality of notches in the pleat folds that extend inwardly towards the center of the band, a flexible member extending through apertures adjacent one end of the band, and a rigid support including a ring. The method of forming the lampshade assembly by the customer includes the one step procedure of moving the rigid support into the interior of the band and towards the flexible member until the ring of the support snaps into place in the notches. In the formed lampshade assembly, the ring pushes outwardly against the opposing inwardly directed force of the resilient band to hold the band, in conjunction with the flexible member, in a position in which the lampshade flares downwardly and outwardly.

8 Claims, 2 Drawing Sheets

LAMP SHADE ASSEMBLY AND THE METHOD OF FORMING SAME

BACKGROUND OF THE INVENTION

1. Field of the Invention

The present invention relates, in general, to a lamp shade assembly of the type including a pleated lamp shade and a support, and the method of forming same.

2. Information Disclosure Statement

It is desirable to have a pleated lamp shade assembly which is economical to manufacture, which can be shipped in a knocked-down condition to alleviate damage to the shade during shipment and to reduce shipping and storage costs, and yet be easily and quickly assembled by the ultimate customer. One attempted solution previously contemplated in the prior art includes the use of a series of deformable hook members each of which must be deformed during assembly of a rigid support member of the lamp shade with the pleated shade as the forming ring of the rigid support member is pushed past each of the hook members. As the forming ring passes the hooked end of each of the hook members the flexible hook member undeforms and returns to its original position. Then, there is required a second step of pulling the rigid support structure back into the retaining hole of each of the hook members where the lip of the retaining member deforms and then snaps back to catch the forming ring of the support member. As the forming ring is caught on all flexible hook members spaced about the pleated material, the lamp shade with the pleated material is assembled.

The above mentioned lamp shade assembly utilizing hook members had various shortcomings, as will be apparent from the above description thereof. Thus, there is the additional manufacturing costs of providing the plurality of hook members and assembling same with the pleated shade. Also, it is apparent that in the two step assembly by the ultimate customer of support structure with the deformable hook members that some difficulty during assembly can occur.

A preliminary patentability search in Class 362, subclass 352, produced the following patents, some of which may be relevant to the present invention: Payne, U.S. Pat. No. 4,605,996, issued Aug. 12, 1986; Payne, U.S. Pat. No. 4,625,268, issued Nov. 25, 1986; Yeh et al, U.S. Pat. No. 4,994,949, issued Feb. 19, 1991; Hyland et al, U.S. Pat. No. 5,121,312, issued Jun. 9, 1992; Hyland et al, U.S. Pat. No. 5,193,902, issued Mar. 16, 1993; and Hyland, U.S. Pat. No. 5,311,415, issued May 10, 1994.

SUMMARY OF THE INVENTION

The present invention is an improved pleated lamp shade assembly which is economical to manufacture, which can be shipped in a knocked-down condition to alleviate damage to the shade during shipment and to reduce shipping and storage costs, and yet is easily and quickly assembled in one movement of the support structure relative to the pleated lamp shade by the ultimate customer.

It is an object of the present invention to provide a lamp shade assembly which only has three parts, i.e., a pleated lamp shade, a flexible member, and a support structure, but which lamp shade assembly has no hook members or the like.

It is a further object of the present invention to provide a simple yet effective method for forming a lamp shade assembly from a knocked-down condition.

DESCRIPTION OF THE PREFERRED EMBODIMENT

Figure 1:
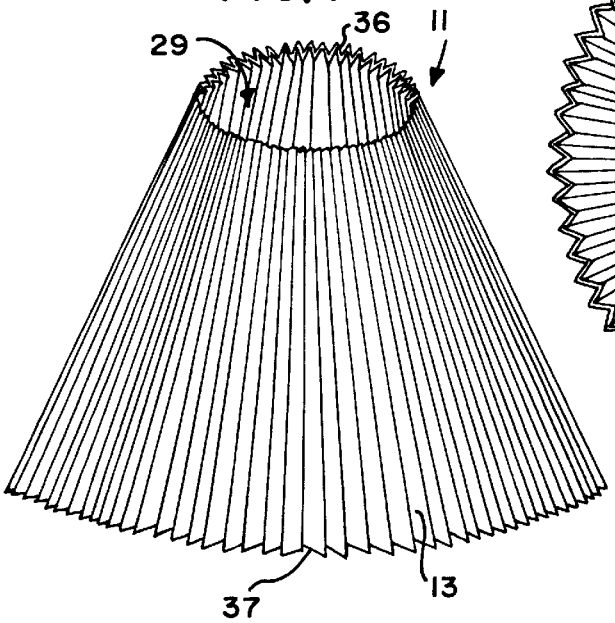
FIG. 1 is a perspective view of the lamp shade assembly of the present invention.

Referring to FIGS. 1–10, lamp shade assembly 11 of the present invention, comprises, in general, lampshade 13, a rigid support 15 for supporting lampshade 13 from a lamp base, not shown, and a flexible member 17.

Lampshade 13 includes a length of resilient pleated material 19 having a first edge 21 and having a second edge 23 joined in overlapping relationship to first edge 21 by suitable means such as stitching, adhesive or the like to form a continuous resilient band 25. The inner side 27 of band 25 defines an open center portion 29 of the band and lampshade 13.

Pleated material 19, and therefore band 25, includes a plurality of folds 31 having inner edges 33 extending inwardly towards open center portion 29 and having outer edges 35 extending outwardly away from open center portion 29. Folds 31 extend lengthwise from first end 36 of band 25 to the second end 37 thereof. A plurality of spaced apertures 39 extend through folds 31 along a horizontal plane at a first level 41 adjacent but spaced from first end 36 of pleated material 19. It will be understood that the first end 36 of pleated material 19 is also the first end 36 of band 25 and lampshade 13. A plurality of notches 43 are respectively provided in inner edges 33 of folds 31 also along a horizontal plane, but at a second level 45 which is spaced from first end 36 a greater distance than the spacing of apertures 39 from first end 36.

As previously stated pleated material 19 is resilient and due to this resiliency when band 25 is expanded outwardly from open center portion 29 by an outside force, band 25 has the characteristic of exerting an opposite and inward force towards open center portion 29. Pleated material 19 is preferably formed, in a manner well known to those skilled in the art, from a suitable resilient plastic, such as vinyl, on the outside of which is provided a suitable fabric laminated with the plastic which serves as a backing for the fabric.

Flexible member 17 is an elongated non-resilient piece of material such as a cord, string or the like which extends through apertures 39 and has the ends thereof fixedly joined together as by a knot or the like to limit the expansion of band 25 at flexible member 17 to a given inside diameter "d".

Figure 2:
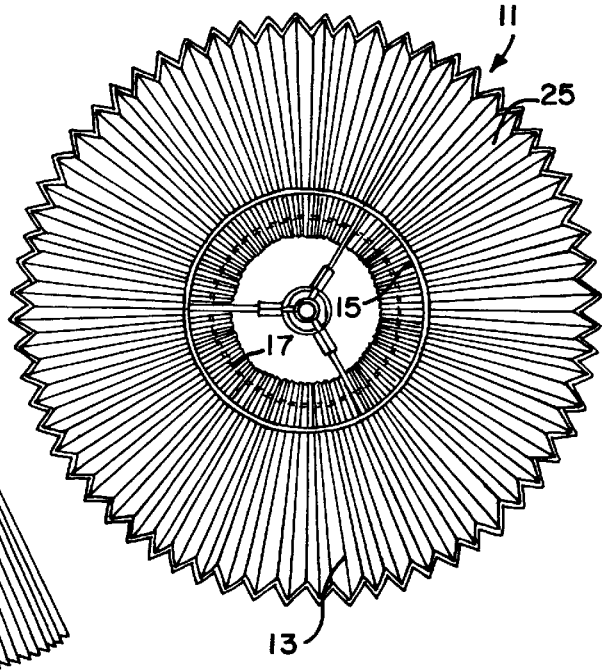
FIG. 2 is a bottom view of the lamp shade assembly of the present invention.
Figure 3:
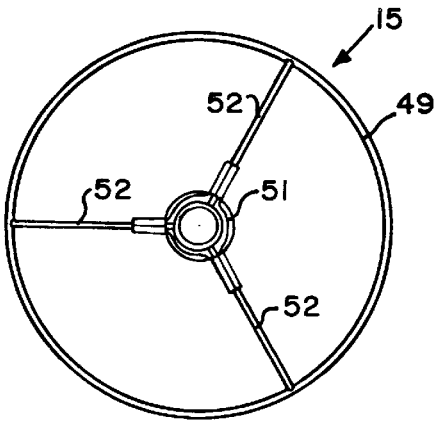
FIG. 3 is a bottom view on an enlarged scale of the support member of the lamp shade assembly.

Rigid support 15 includes a ring 49 of a larger outside diameter than the given inside diameter "d" of band 25 at flexible member 17. When lamp shade assembly 11 is in an assembled condition as depicted in FIGS. 1 & 2, ring 49 extends into notches 43 in the inner edges 33 of folds 31 and holds band 25 at ring 49 outwardly against the opposing inwardly directed force of resilient pleated material 19. Thus, ring 49 holds band 25, in conjunction with flexible member 17 in a position in which lampshade 13 flares outwardly from first end 36 to second end 37. In other words, in the assembled disposition of lampshade assembly 11, the lampshade 13 is held in a substantially frusto-conical disposition.

Support 15 preferably includes a smaller ring or collar 51 for placement over a threaded member to be attached to the lamp base in a manner well known to those skilled in the art. In addition, support 15 preferably includes braces 52 fixedly attached at the opposite ends thereof to collar 51 and ring 49.

Figure 4:
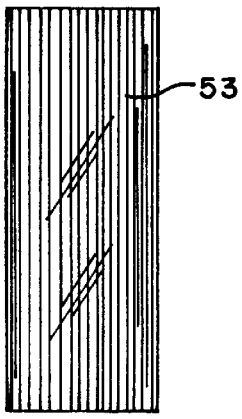
FIG. 4 is side elevational view of the pleated lamp shade packaged in a plastic sleeve ready for shipping.
Figure 5:
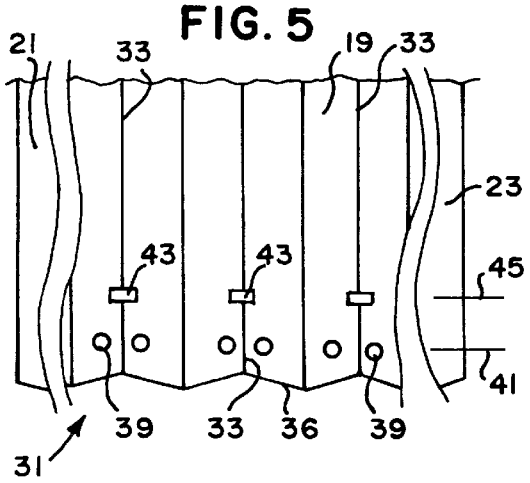
FIG. 5 is a view of a portion of the pleated material with the material almost flattened out to illustrate the apertures through which the flexible member is to be threaded and to illustrate the rectangular openings which when the folds are disposed in their normal disposition will form notches.
Figure 6:
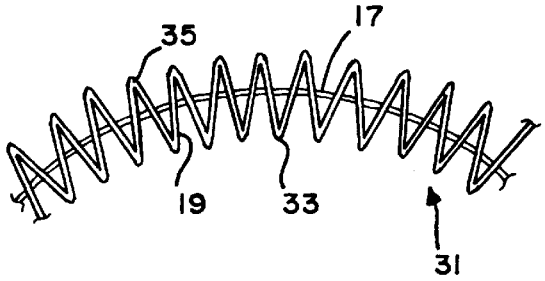
FIG. 6 is a diagrammatic view showing the flexible member after being threaded through the apertures in the pleated material.

The lamp shade 13 is preferably assembled with the flexible member 17 at the manufacturing plant and is shipped in a knocked-down condition with the support 15 being provided in the shipping carton separate from the lamp shade 13. The lamp shade 13 with the flexible member 17 in place is preferably first packaged in a plastic cylindrical sleeve 53 as depicted in FIG. 4 before being placed in the shipping carton with the support 15. Thus, the ultimate consumer has only to assemble two parts, namely, (1) the lamp shade 13, which already has the flexible member 17 in place, and (2) the support 15. The assembly of these two parts is a very quick and easy operation for the consumer, as will be appreciated from the following description of the assembly thereof.

Figure 7:
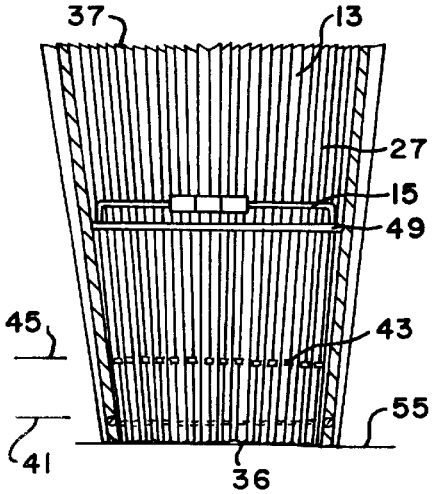
FIG. 7 is a somewhat diagrammatic cross sectional view of the lamp shade showing the support member partially extended into the lamp shade during the assembly of the lamp shade assembly.
Figure 8:
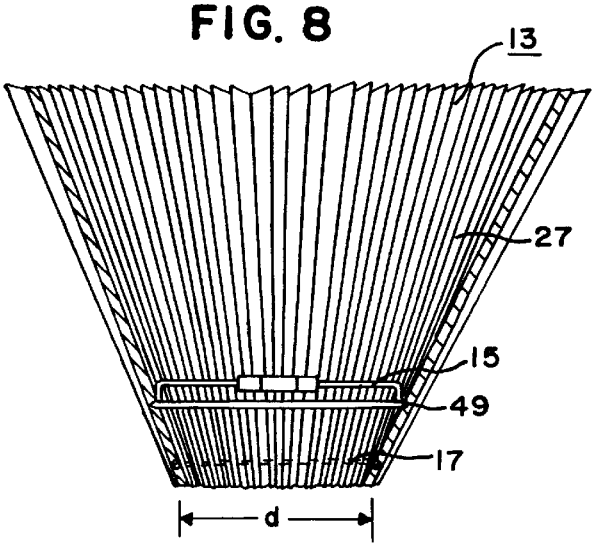
FIG. 8 is a view similar to FIG. 7, but showing the support member after it has been snapped into place in the lamp shade notches.
Figure 9:
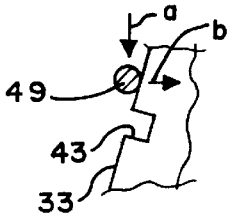
FIG. 9 is a fragmentary view of a portion of one of the folds in the lamp shade illustrating the ring (in cross section) of the support member pressing outwardly against the inside of the lamp shade and just before snapping into place in its associated notch.
Figure 10:
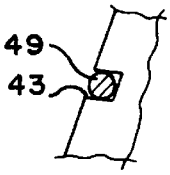
FIG. 10 is a view similar to FIG. 9, but showing the ring of the support member after being snapped into place in its associated notch.

Having removed the combined lamp shade 13 and the attached flexible member 17 from sleeve 53, the lamp shade 13 with the flexible member therein is turned upside down from the normal position of the lamp shade assembly 11 during use. Then, the first end 36 of lamp shade 13 is placed on a supporting surface 55 as depicted in FIG. 7. Next, support 15 is placed through second end 37 into the open center portion 29 of band 25 and pushed downwardly against the inner side 27 of band 25 with ring 49 being held substantially horizontal. It will be understood that as the support 15 and ring 49 is moved downwardly as shown by the arrow at "a", the outside edge of ring 49 will slide along inner edges 33 of folds 31 which exerts an outward force against inner edges 33, as depicted by the arrow at "b" in FIG. 9, until ring 49 reaches notches 43, whereupon ring 49 will snap into place in the notches 43 as depicted in FIG. 10 to complete the assembly of lamp shade assembly 11. It will be further understood that when the support 15 is moved downwardly, as above described, the band 25 will flare outwardly from first end 36 towards second end 37 until the band 25 reaches the frusto-conical shape in the finished lamp assembly 11 as shown in FIG. 8.

From the foregoing it will be seen that not only is the method and lamp shade assembly an improvement for the manufacturer in not having the expense and difficulty in manufacturing and assembling the hook members of prior lamp shades, as well as the reduction in shipping costs, but it is an improvement for the ultimate consumer due to the simplicity and ease of assembling the support with the lamp shade per se in one quick movement.

Although the present invention has been described and illustrated with respect to a preferred embodiment and a preferred use therefor, it is not to be so limited since modifications and changes can be made therein which are within the full intended scope of the invention.

I claim:

1. A lampshade assembly, said lampshade assembly comprising:

(a) a lampshade including a length of resilient pleated material formed as a continuous resilient band having a first end, a second end, a first edge and a second edge joined to said first edge to establish said band, an inner side defining an open center portion of the band, and an outer side remote from said center portion, said band when expanded outwardly from said open center portion by an outside force having the characteristics of exerting an opposite and inward force towards said open center portion, said pleated material including a plurality of folds having inner edges extending inwardly towards said open center portion and outer edges extending outwardly away from said open center portion, a plurality of spaced apertures extending through said folds, a plurality of notches provided in said inner edges of said folds;

(b) a flexible member extending through said apertures in said folds to limit the expansion of said band at said flexible member to a given diameter; and (c) a rigid support including a ring of larger diameter than said given diameter, said ring extending into said notches in said inner edges of said folds holding said band at said ring outwardly against the opposing inwardly directed force of said band to hold said band in conjunction with said flexible member in a position in which said lampshade flares outwardly from said first end to said second ends; said ring being forcibly received into said notches and said lampshade being held onto said ring by said opposite and inward force caused by the resilience of said pleated material.

2. The lampshade assembly of claim 1 in which said plurality of apertures extend along a first level spaced from said first end of said band, and in which said plurality of notches extend along a second level which is spaced from said first end of said band a greater distance than the spacing of said apertures from said first end of said band.

3. The lampshade assembly of claim 2 in which said ring holds said band in a substantially frusto-conical disposition.

4. The lampshade assembly of claim 3 in which said folds extend lengthwise from said first end of said band to the second end thereof.

5. A method of forming a lamp shade assembly comprising the steps of:

(a) providing a lampshade including a length of resilient pleated material formed as a continuous resilient band having a first end, a second end, an inner side defining an open center portion of the band, said band when expanded outwardly from said open center portion by an outside force having the characteristics of exerting an opposite and inward force towards said open center portion, said pleated material including a plurality of folds having inner edges extending inwardly towards said open center portion and outer edges extending outwardly away from said open center portion, said folds extending lengthwise from said first end of said band to said second end of said band; said lamp shade having a plurality of apertures extending through said folds at a first level adjacent but spaced from said first end of said band, and having a plurality of notches in said inner edges of said folds at a second level which is spaced from said first end of said band a greater distance than the spacing of said apertures from said first end;

(b) providing a continuous flexible member extending through said apertures in said folds to limit the expansion of said first end of said band at said flexible member to a given diameter;

(c) providing a rigid support including a ring of larger diameter than said given diameter; and (d) inserting said ring into said open center through said second end of said band and moving said ring towards said first end while pushing said ring against said inner edges to exert an outward force against the opposing inwardly directed force of said resilient pleated material until said ring snaps into place in said notches, said ring being forcibly received into said notches and said lampshade being held onto said ring by said opposite and inward force caused by the resilience of said pleated material, and said band being held in a position in which, in conjunction with said flexible member, causes said lampshade to flare outwardly from said first end towards said second end of said band.

6. A method of forming a lamp shade assembly comprising the steps of:

(a) providing a lampshade including a length of resilient pleated material formed as a continuous resilient band having a first end, a second end, a first edge and a second edge joined to said first edge to establish said band, an inner side defining an open center portion of the band, and an outer side remote from said center portion, said band when expanded outwardly from said open center portion by an outside force having the characteristics of exerting an opposite and inward force towards said open center portion, said pleated material including a plurality of folds having inner edges extending inwardly towards said open center portion and outer edges extending outwardly away from said open center portion, said folds extending lengthwise from said first end of said band to said second end of said band;

(b) forming a plurality of apertures extending through said folds at a first level adjacent but spaced from said first end of said band, (c) forming a plurality of notches in said inner edges of said folds at a second level which is spaced from said first end of said band a greater distance than the spacing of said apertures from said first end;

(d) providing a flexible member having opposite ends;

(e) inserting said flexible member through said apertures in said folds and fixedly joining the opposite ends thereof to limit the expansion of said first end of said band at said flexible member to a given diameter;

(f) providing a rigid support including a ring of larger diameter than said given diameter; and (g) inserting said ring into said open center through said second end of said band and moving said ring towards said first end while pushing said ring against said inner edges to exert an outward force against the opposing inwardly directed force of said resilient pleated material until said ring snaps into place in said notches, said ring being forcibly received into said notches and said lampshade being held onto said ring by said opposite and inward force caused by the resilience of said pleated material, and said band being held in a position in which, in conjunction with said flexible member, causes said lampshade to flare outwardly from said first end towards said second end of said band.

7. The method of claim 6 in which said plurality of apertures extend along a substantially horizontal level, and in which said plurality of notches extend along a substantially horizontal level.

8. The method of claim 7 in which said ring holds said band in a substantially frusto-conical disposition.

* * * * *